United States Patent [19]

Kunishi

[11] Patent Number: 4,900,268

[45] Date of Patent: Feb. 13, 1990

[54] ELECTRIC CONNECTOR FOR FLAT FLEXIBLE CABLES

[75] Inventor: Shinsuke Kunishi, Yamato, Japan

[73] Assignee: Molex Incorporated

[21] Appl. No.: 281,578

[22] Filed: Dec. 8, 1988

[30] Foreign Application Priority Data

Dec. 8, 1987 [JP] Japan ..... 62-187085[U]

[51] Int. Cl.[4] ..... H01R 23/04

[52] U.S. Cl. ..... 439/493

[58] Field of Search ..... 439/492–499

[56] References Cited

U.S. PATENT DOCUMENTS 3,923,364 12/1975 Shapiro et al. ..... 439/493

4,526,436 7/1985 Aso ..... 439/493

*Primary Examiner*—Joseph H. McGlynn

*Attorney, Agent, or Firm*—Louis A. Hecht; Stephen Z. Weiss

[57] ABSTRACT

Disclosed is an electric connector for connecting a flat flexible cable to an electric circuit, which connector is capable of putting its contact tips in exact registration with corresponding stripped conductor ends, thereby guaranting the connector free of poor contact between the conductors of the cable and the corresponding terminals of the circuit. A flat cable to be used in combination with the connector has enlarged conductor contact area alternately staggered with each other. The connector has forked terminal contacts each having a short or long front leg and a rear leg. The short-legged terminal contacts are designed to contact the enlarged conductor contact areas aligned in the forward transverse line whereas the long-legged terminal contacts are designed to contact the enlarged conductor contact areas aligned in the backward transverse line.

1 Claim, 3 Drawing Sheets

ELECTRIC CONNECTOR FOR FLAT FLEXIBLE CABLES

BACKGROUND OF THE INVENTION

1. Field of the Invention

The present invention relates to an electric connector for a flat flexible cable, and more particularly to an electric connector for a flat flexible cable having a plurality of flat conductors arranged at reduced intervals, permitting their exposed terminal ends to contact corresponding terminals of a printed circuit, which terminals are arranged at reduced intervals on a printed circuit board.

2. Description of the Prior Art

As is well known, usually flat flexible cables are connected to printed circuits with the aid of electric connectors. A conventional flat flexible cable has a plurality of flat conductors embedded in a flexible insulator material. These conductors are stripped and exposed at their ends.

Recently, a plurality of conductors have been arranged on a circuit board with as much density as possible to meet the repuirement for reduction the size of electric or electronic apparatus. For example, the conductors in a flat flexible cable are arranged at the regular interval of 0.5 mm.

Also, the side-to-side dimension or width of a conductor is reduced accordingly. As a result it is very difficult to put the thin contacts of an electric connector in perfect registnation with the stripped ends of corresponding conductors of the flat cable, thus causing poor electric contact between the cable and the connector, and hence between the cable and the printed circuit. In putting the stripped ends of the flat flexible cable in contact with the contacts of the electric connector, first, the cable is inserted in the electric connector housing, and then, a plug is pushed over the stripped ends of the cable into the electric connector housing. This two-step insertion increases the tendency of poor contact between the stripped ends of the cable and the contacts of the connector.

SUMMARY OF THE INVENTION

One object of the present invention is to provide an electric connector which assures good contact between the stripped ends of a flat flexible cable and the contacts of an electric connector even if the cable conductors are arranged at possible minimum intervals.

Another object of the present invention is to provide an electric connector which can be fixed to a printed circuit board in a most stable way whether it may be applied directly to the surface of the circuit board or may be used in board-in or plug-in fashion.

Still another object of the present invention is to provide an electric connector which permits the insertion of a plug or wedge into the housing of the connector with a reduced force, compared with that which would be required in inserting a plug or wedge into the housing of a conventional electric connector.

To attain these objects a cable connector according to the present invention is designed to be used in combination with a flat flexible cable having a plurality of conductors arranged at regular intervals, the exposed terminal ends of these conductors having enlarged contact areas staggered with each other in forward and backward transverse lines.

The cable connector comprises a connector housing having a terminal contact mounting space; forked terminal contacts as many as the flat conductors of the cable, said forked terminal contacts being arranged at the same intervals as the flat conductors of the cable and being mounted in the terminal contact mounting space of the connector housing, alternate terminal contacts having a terminal projection appearing at one side of the connector housing for connecting a corresponding conductor of the electric circuit, a rear leg and a relatively short front leg adequate to reach each exposed terminal end arranged in the forward transverse line, whereas the other alternate terminal contacts having a terminal projection appearing at the other side of the connector housing for connecting a corresponding conductor of the electric circuit, a rear leg and a relatively long front leg adequate to reach each exposed terminal end arranged in the backward transverse line.

In a flat flexible cable a plurality of conductors are arranged at regular intervals with their exposed terminal ends staggered with each other in forward and backward transverse lines. Thanks to this staggered arrangement each stripped terminal end can have a side-to-side dimension or width greater than the width of the thin flat conductor, thereby assuring good contact with the corresponding contacts of the electric connector.

Other objects and advantages of the present invention will be understood from the following description of a preferred embodiment which is shown in the accompanying drawings.

Figure 1:
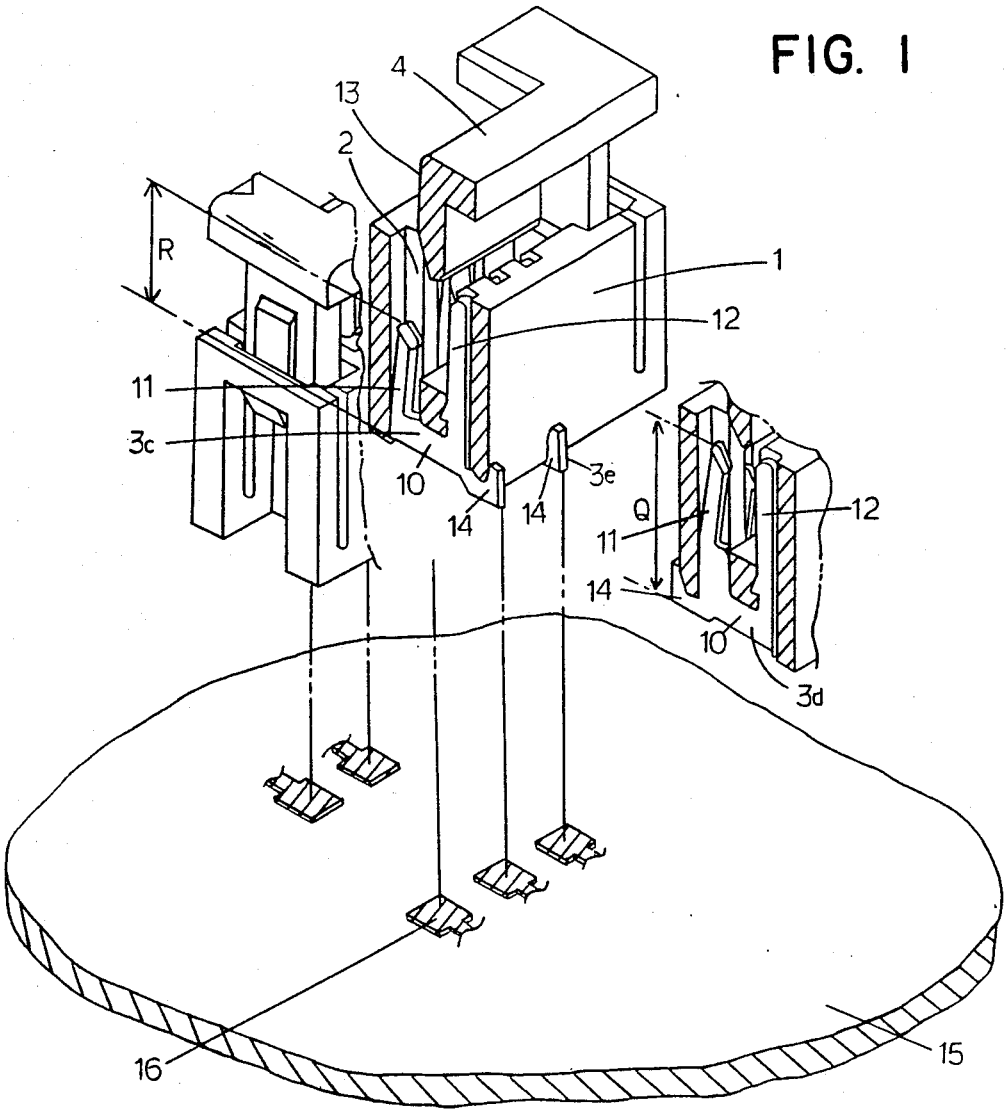
FIG. 1 is a perspective view of an electric connector partly broken along with a fragment of a printed circuit board.

Referring to FIG. 1, an electric connector for connecting a flat flexible cable to an electric circuit is shown. Its housing 1 has a terminal contact mounting space 2. Terminal contacts 3*a*, 3*b*, 3*c* . . . are mounted in the terminal contact mounting space 2 of the connector housing 1. A plug or wedge is indicated at 4. A cable 5, which is called flexible flat cable (FFC) or flexible printed circuit (FPC), is shown as comprising as a plurality of flat thin conductors 6*a*, 6*b*, 6*c* . . . arranged at given regular intervals. FIGS. 2, 3, 4 and 5 show different examples of flat flexible cables, which may be used in combination with the connector. Referring to these drawings, flat flexible cables 5 are described below in detail.

Figure 2:
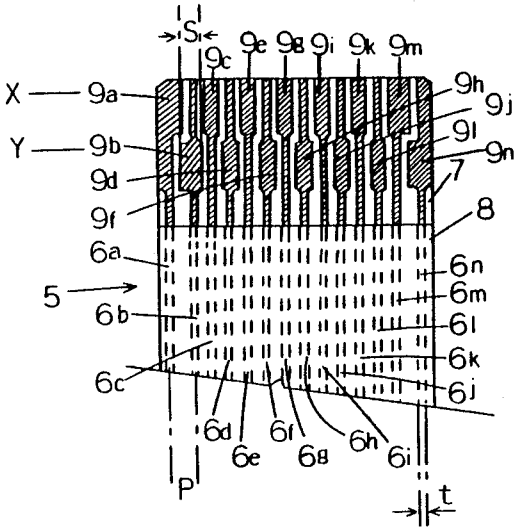
FIGS. 2 to 5 show stripped terminal ends of different flat flexible cables.

First, referring to FIG. 2, fourteen flat cables 6*a* to 6*n* are arranged parallel with each other at possible minimum interval. The alternate conductors 6*a*, 6*c*, 6*e*, 6*g*, 6*i*, 6*k* and 6*m* have stripped enlarged contact areas 9*a*, 9*c*, 9*e*, 9*g*, 9*i*, 9*k* and 9*m* aligned in the forward transverse line X whereas the remaining alternate conductors 6*b*, 6*d*, 6*f*, 6*h*, 6*j*, 6*l* and 6*n* have stripped enlarged contact areas 9*b*, 9*d*, 9*f*, 9*h*, 9*j*, 9*l* and 9*n* aligned in the backward transverse line Y. Thus, these conductors are arranged with their enlarged contact areas staggered with each other in the forward and backward transverse lines X and Y. Thanks to this staggered arrangement each stripped terminal end can have a side-to-side dimension or width S greater than the width T of the thin flat conductor.

Figure 3:
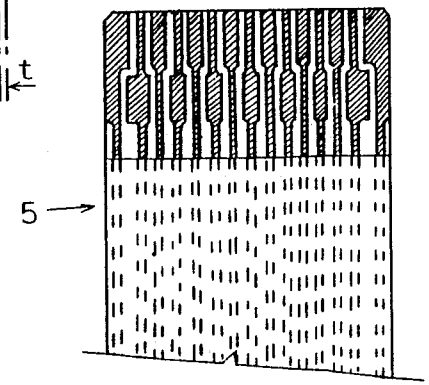
Figure 4:
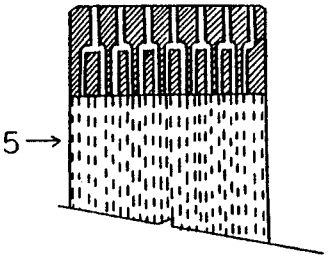
Figure 5:
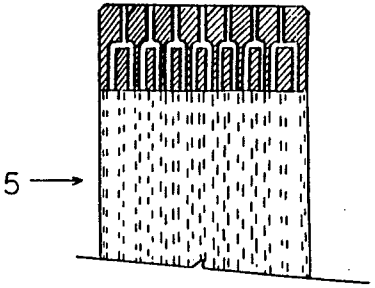
Figure 8:
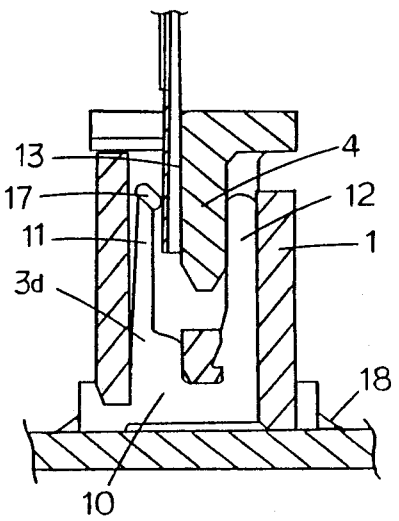
FIG. 8 is a view similar to FIG. 6, showing a stripped terminal end in contact with the contact in the connector.

FIGS. 3, 4 and 5 show different modes of flat flexible cables. The enlarged contact areas of the stripped terminal ends are alternately staggered with each other.

Figure 7:
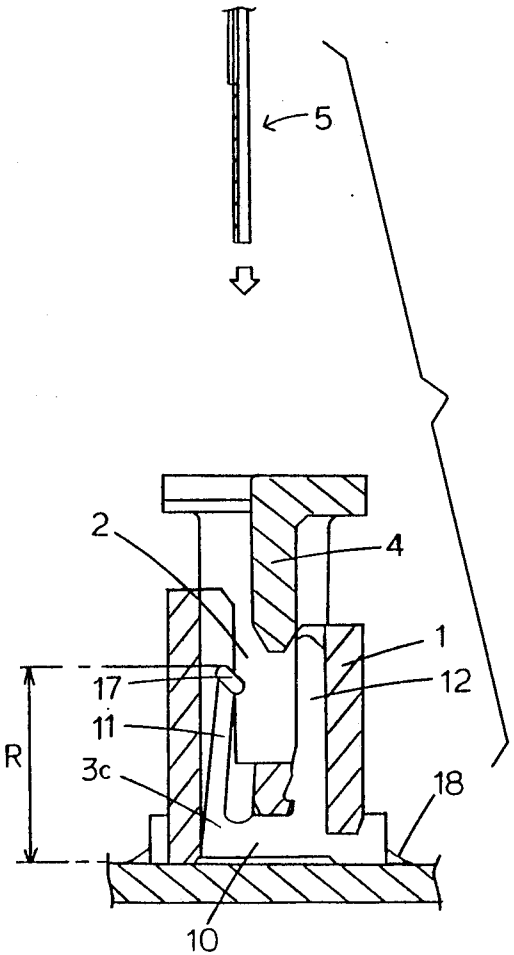
FIG. 7 is a longitudinal section of the electric connector, showing a given contact which is to be put in contact with a selected one among the stripped terminal ends arranged in the forward transverse line.
Figure 6:
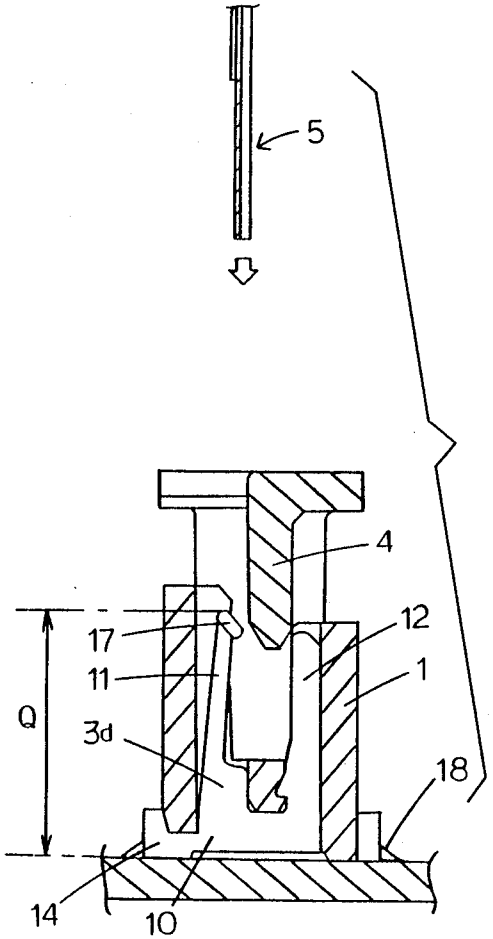
FIG. 6 is a longitudinal section of the electric connector, showing a given contact which is to be put in contact with a selected one among the stripped terminal ends arranged in the backward transverse line.

As regards the forked terminal contacts 3*a*, 3*b*, 3*c* . . . each terminal contact comprises a base 10, front and rear legs 11 and 12 integrally connected to the opposite ends of the base 10 and a terminal projection 14 integrally connected to one end of the base 10. The front leg 11 of each forked terminal contact is adapted to contact the stripped end of a selected conductor 6*a*, 6*b* . . . It should be noted that the terminal contacts 3*a*, 3*c*, 3*e*, 3*g*, 3*l*, 3*k* and 3*m* which are designed to contact the stripped conductor ends 9*a*, 9*c*, 9*e*, 9*g*, 9*i*, 9*k* and 9*m* aligned in the forward transverse line X, have a relatively short front leg R, as shown in FIG. 7, and that the terminal contacts 3*b*, 3*d*, 3*f*, 3*h*, 3*j*, 3*l* and 3*n* which are designed to contact the stripped conductor 9*b*, 9*d*, 9*f*, 9*h*, 9*j*, 9*l* and 9*n* aligned in the line Y, have a relatively long front leg Q, as shown in FIG. 6. In FIG. 1 only the terminals 3*c* and 3*d* are shown. The front legs of the forked terminal contacts resiliently push the stripped ends of the conductors against the surface of the plug or weage 4 when inserted into the connector housing 1. As a matter of course the short front legs are long enough to reach the enlarged contact areas aligned in the forward transverse line X, and the long front legs are long enough to reach the enlarged contact areas aligned in the line Y. As for the terminal projection 14 it is integrally connected to one end of the base of the forked terminal contact. Specifically, each of the terminal contacts which are allotted to the enlarged contact areas alligned in the forward transverse line X, has a terminal projection integrally connected to the right end of its base. Likewise, each of the terminal contacts which are allotted to the enlarged contact areas aligned in the backward transverse line Y, has a terminal-projection integrally connected to the left end of its base. When the long-legged and short-legged terminal contacts are arranged alternately and fitted in the contact mounting space of the connector housing, their terminal projections appear alternately on either side of the connector housing. Specifically, the terminal projections 14 of the long-legged terminal contacts 3*a*, 3*c* . . . appear on the right side of the connector housing 1 whereas the terminal projections 14 of the short-legged terminal contacts 3*b*, 3*d* . . . appear on the left side of the connector housing 1.

In this particular embodiment the connector housing 1 is fixed to the surface of the printed circuit board 15 by soldering the terminal projections 14 to the terminals 16 of a printed circuit, as indicated at 18. The terminal projection 14 may be in the form of pin, and then a printed circuit board 15 can be connected to a flat flexible cable in the board-in fashion.

In use the plug or wedge 4 is put at the entrance of the connector housing 1, as shown in FIG. 6 or 7. FIG. 6 shows a long-legged terminal contact 3*d* whereas FIG. 7 shows a short-legged terminal contact 3*c*.

The stripped end of the flat flexible cable 5 is inserted in the inner space 2 of the connector housing 1 with the exposed conductors facing the front legs of the terminal contacts. Then, the plug or wedge 4 is pushed in the space defined by the front and rear legs of the terminal contacts, therby causing the front legs 11 of the terminal contacts to push the exposed conductors against the surface of the plug 4. Specifically, the contact points 17 of the short-legged terminal contacts 3*a*, 3*c*, 3*e* . . . will contact the enlarged contact areas of the stripped conductor ends 9*a*, 9*c*, 9*e* . . . *l whereas the contact points 17 of the long-legged terminal contacts 3b,* 3*d*, 3*f* . . . will contact the enlarged contact areas of the stripped conductor ends 9*b*, 9*d*, 9*f* . . . .

As earlier described, the conductors in the cable are arranged at reduced intervals, and the enlarged contact areas of the exposed ends of the conductors are staggered with each other. This staggered arrangement of enlarged contact areas assures good electrical contact between the stripped conductor ends of the cable and the tips of the terminal contact. Such staggered arrangement of enlarged contact areas in the cable and similar staggered arrangement of short- and long-legged terminal contacts in the connector together will be effective in preventing poor contact between the cable conductors and the terminal contacts, which otherwise, would be caused by first, inserting the stripped end of the cable and later, the plug or wedge in the connector housing.

Also, the terminal projections are arranged on either side of the connector housing at intervals two times as much as the terminal contacts, and therefore the connector housing can be fixed stable and at the same time, the possibility of short-circuiting or bridging between adjacent terminal projections will be substantially reduced, compared with a connector having terminal projections on one side at the same intervals as the terminal contacts.

Advantageously, the plug or wedge can be pushed in the connector housing with a reduced force. Because the contact tips of the terminal contacts are arranged in two transverse lines, one half of the contact tips being in the forward line and the other half in the backward line. Thus, the number of the contact tips which the plug or wedge meet, will be half as many as that which the plug or wedge meet when it is inserted in the contact housing in which all contact tips are alligned in a single line, as in the conventional electric connector.

What is claimed is:

1. An electric connector for connecting to an electric circuit a flat flexible cable 5 having a plurality of conductors 6*a*–6*n* arranged at regular intervals P, the exposed terminal ends of these conductors 9*a*–9*n*, having enlarged contact areas S staggered with each other in forward and backward transverse lines X and Y, said electric connector comprising a connector housing 1 having a terminal contact mounting space 2; forked terminal contacts 3*a*, 3*b*, 3*c* . . . as many as the flat conductors of the cable 5, said forked terminal contacts being arranged at the same intervals as the flat conductors of the cable 5 and being mounted in the terminal contact mounting space 2 of the connector housing 1, alternate terminal contacts 3*a*, 3*c*, 3*e* . . . having a terminal projection 14 appearing at one side of the connector housing 1 for connecting a corresponding conductor of the electric circuit, a rear leg 12 and a relatively short front leg 11 adequate to reach each exposed terminal end 9*a*, 9*c*, 9*e*, 9*g*, 9*i*, 9*k* or 9*m* arranged in the forward transverse line, whereas the other alternate terminal contacts 3*b*, 3*d* . . . having a terminal projection 14 appearing at the other side of the connector housing 1 for connecting a corresponding conductor of the electric circuit, a rear leg 12 and a relatively long front leg 11 adequate to reach each exposed terminal end 9*b*, 9*d*, 9*f*, 9*h*, 9*j*, 9*l* or 9*n* arranged in the backward transverse line Y.

* * * * *